United States Patent [19]

Chen

[11] Patent Number: 4,854,043

[45] Date of Patent: Aug. 8, 1989

[54] FLEXIBLE RAZOR HEAD

[75] Inventor: Evan N. Chen, Fairfield, Conn.

[73] Assignee: Warner-Lambert Company, Morris Plains, N.J.

[21] Appl. No.: 115,781

[22] Filed: Oct. 30, 1987

[51] Int. Cl.[4] ..... B26B 21/16

[52] U.S. Cl. ..... 30/50; 30/32; 30/49

[58] Field of Search ..... 30/47–50, 30/32, 84, 85

[56] References Cited

U.S. PATENT DOCUMENTS 4,443,939 4/1984 Motta et al. ..... 30/49

4,459,744 7/1984 Esnard ..... 30/49

*Primary Examiner*—Douglas D. Watts

*Attorney, Agent, or Firm*—Howard Olevsky; Daniel A. Scola, Jr.

[57] ABSTRACT

According to this invention a flexible razor head is provided which features a flexible cap and blade support portion with the blade support portion featuring a segmented guard bar with the spaces separating the segment correlating to the spaces or areas of reduced thickness in the cap. Corrugations present in the blade support portions enable the blade support portion to lengthen in response to shaving forces.

4 Claims, 6 Drawing Sheets

10
14
12
13
14
5
8
5
9
11
5
7
31C
32B
31B
32A
31A
30
37C
38B
37B
38A
37A
31C'
32B'
31B'
32A'
31A'
30'
29
8
25C
24
28
25B
24
8
5
25A
20
21
21
27
23

FLEXIBLE RAZOR HEAD

FIELD OF THE INVENTION

This invention relates to a razor head in particularly a razor head which is moveable in response to shaving forces.

BACKGROUND OF THE INVENTION

Recently several razors have featured shaving heads designed to be dynamically moveable in response to various forces exerted during shaving. An example of such a razor head is the pivoting cartridge sold under the trademark ULTREX by the Schick Safety Razor Group of the Warner-Lambert Company. Such a cartridge pivots about fixed pivot points provided by a handle in response to razor movement during shaving.

A razor head is defined herein and throughout the specification as the combination of a razor blade cap, a razor blade support surface having a guard bar depending outward therefrom and either a single razor blade or a combination of two blades separated by a spacer means with the bottom blade extending farther outward toward the user during shaving than the top blade. The razor head as used herein includes both disposable razors wherein the head and handle are unitary and a cartridge per se used with a permanent handle.

Several patents recently issued to Jacobson, e.g. U.S. Pat. No. 4,446,619 feature individual spring mounting of blades and, additionally, in some instances, a guard bar to provide vertical movement in response to shaving forces. The blades and guard bar are designed to move up and down within the razor cartridge as shaving force is exerted against them. The cap in the Jacobson configurations provide a limiting feature for travel of the uppermost blade in the two blade system and is fixed to the remaining, non-moveable parts of the cartridge. The Jacobson concept, however, does not take into account the configuration of the face which tends to be made up of a flexible series of arcs and angles rather than separate distinct planes.

Other examples of dynamic shaving are found, for example, in U.S. Pat. No. 4,443,939 issued to Vincent C. Motta and Ernest F. Kiraly on Apr. 24, 1984. This razor head configuration discloses a razor cap having corrugated segments disposed on either side of the cap center as well as a guard bar which is individually segmented and a seat portion of the blade support structure from which the guard bar depends having a convoluted, cage-like structure. The spacer in this two blade system has cut out areas to increase flexibility and the blades feature extended longitudinal slots.

The Motta patent describes suspending the cartridge by keyholes provided in the blade support portion and matching key-like projections extending from a handle. The pin means depending downward from the cap of Motta was designed to maintain the individual elements of the razor head in a predetermined configuration. To this end a snap fit configuration for the pin means was provided in which a necked-in portion of the pin means is positioned between an enlarged lower portion and an enlarged upper portion. The lower portion cross sectional diameter is somewhat larger than the receiving holes in the blade support portion. The holes are, however, chamfered to provide sufficient flexibility for the pins to be "snap fit" with the bulbous bottom end passing through the chamfered hole and providing an anchoring site. The tapering necked-in portion allows the blade package comprising the upper blade, spacer and lower blade to ride upward in response to downward forces exerted against the razor head. The upper movement is defined by the length of the necked-in portion.

Another approach for the design of a flexible razor head is found in U.S. Pat. Nos. 4,069,580 issued Jan. 24, 1978, 4,409,735 and resissue U.S. Pat No. 30,913 reissued Apr. 27, 1982 by Syral A. Cartwright et al. This dynamically flexible razor head features a pinless assembly in which the head components are held together either by adhesive strips contacting each of the elements or, in the embodiment depicted at FIG. 7, the blades are inserted into a premolded razor head with slots. The Cartwright embodiment depicted at FIG. 7 shows a fingered cap with the fingers being separated by spaces coinciding with spaces separating ribs of blade support portions for the bottom-most blade in a two-blade system. The blades are inset into mating slots in this particular embodiment. The razor head of Cartwright is also suspended by pins in much the same way as the razor head described in Motta.

Another example of a razor having dynamically moveable elements is described in U.S. Pat. No. 4,516,320 issued to Anthony J. Peleckis in which the razor blade assembly is supported only at each end, and therefore deflects in response to shaving forces while the guard bar moves backward and upward due to certain constructional features.

Each of the razor systems wherein the razor head is moveable suffers from some disadvantage. Both the Cartwright and Motta razor heads, by using cantilevered attachment means are extremely difficult to assemble and the pins utilized for attachment to the handle tend to snap off in response to conventional shaving forces. Moreover, in the case of Motta, flexibility is inhibited because the blade support portion including the guard bar and the cap flex at different flex points. This tends to inhibit the overall flexibility of the razor head.

In the case of FIG. 7 in Cartwright, both cap and blade support portion have open areas which are aligned with each other but the blades are inhibited from free movement by the clamping associated with the slots formed for them in the one piece cap and support structure. The use of relatively thick support ribs also tends to inhibit flexibility.

SUMMARY OF THE INVENTION

According to this invention a flexible razor head is provided which features a flexible cap and blade support portion with the blade support portion featuring a segmented guard bar; with the spaces separating the segment correlating to the spaces or areas of reduced thickness in the cap. Corrugations present in the blade support portions enable the blade support portion to lengthen in response to shaving forces.

BRIEF DESCRIPTION OF THE DRAWINGS

The invention can be more readily understood by reference to the drawings in which.

DETAILED DESCRIPTION OF THE INVENTION

Figure 1:
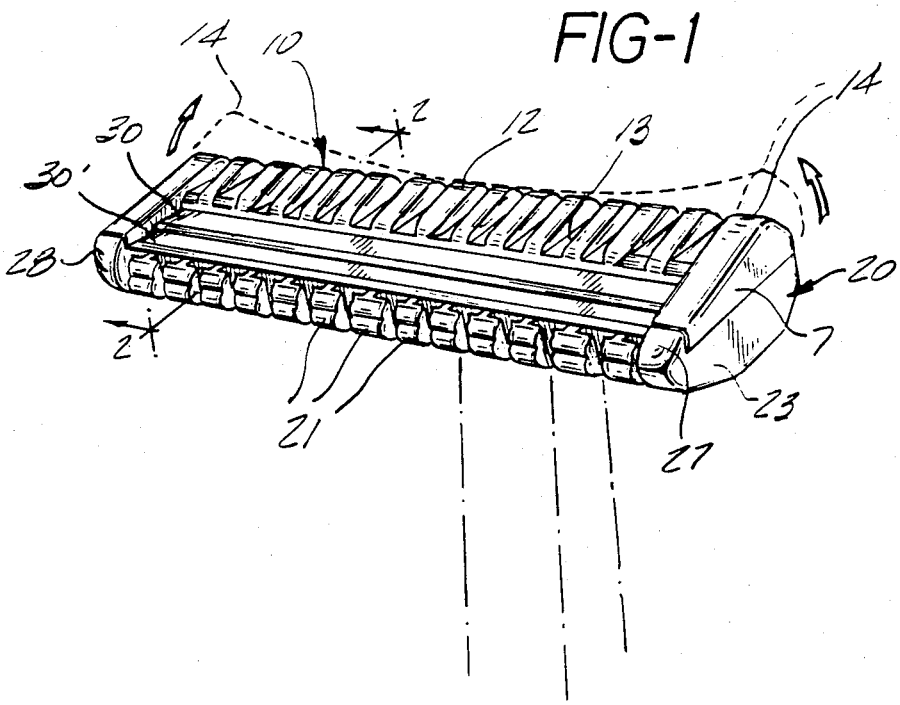
FIG. 1 is a perspective view of the assembled razor head in accordance with this invention.
Figure 3:
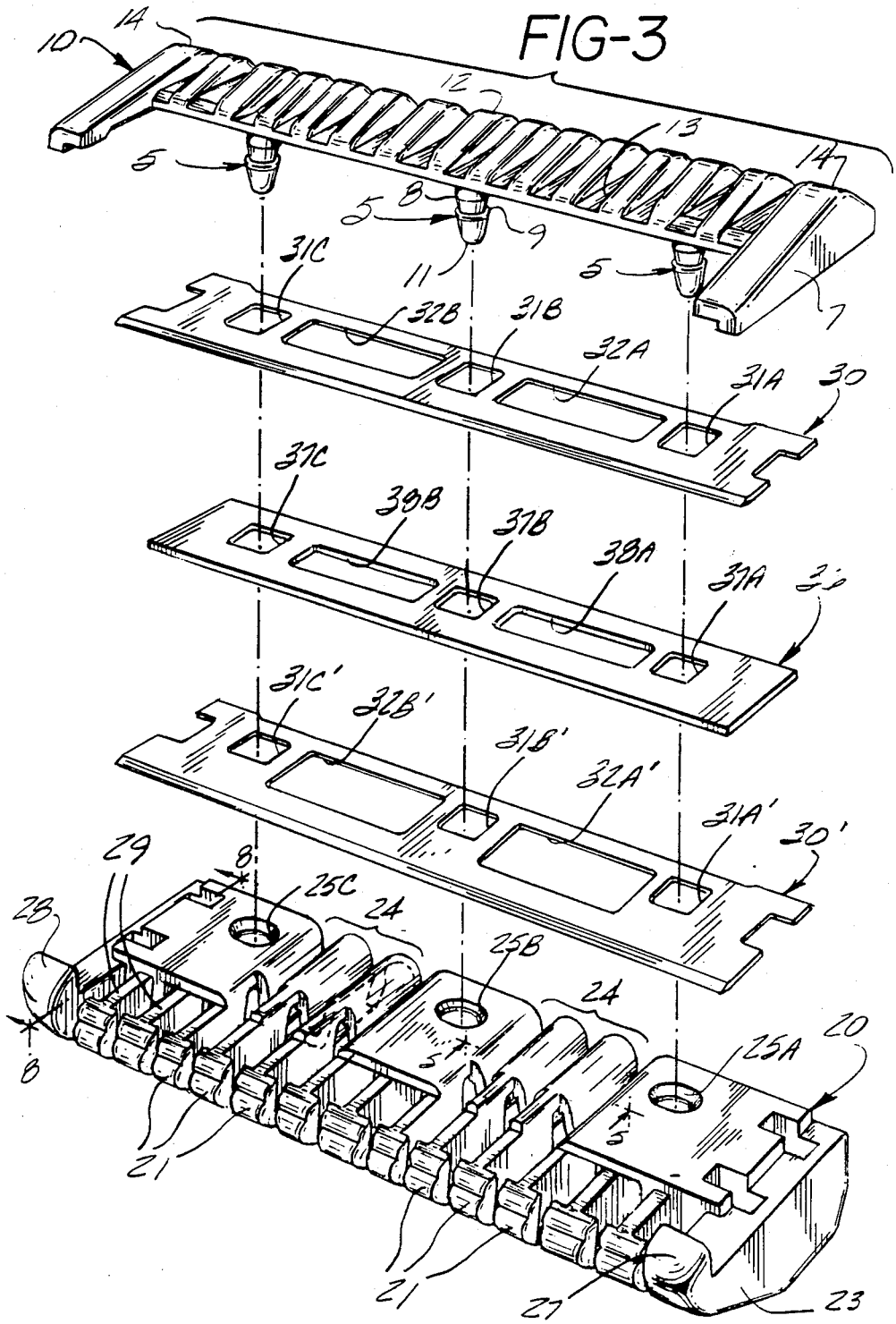
FIG. 3 is an exploded perspective view of the components of the razor head.
Figure 4:
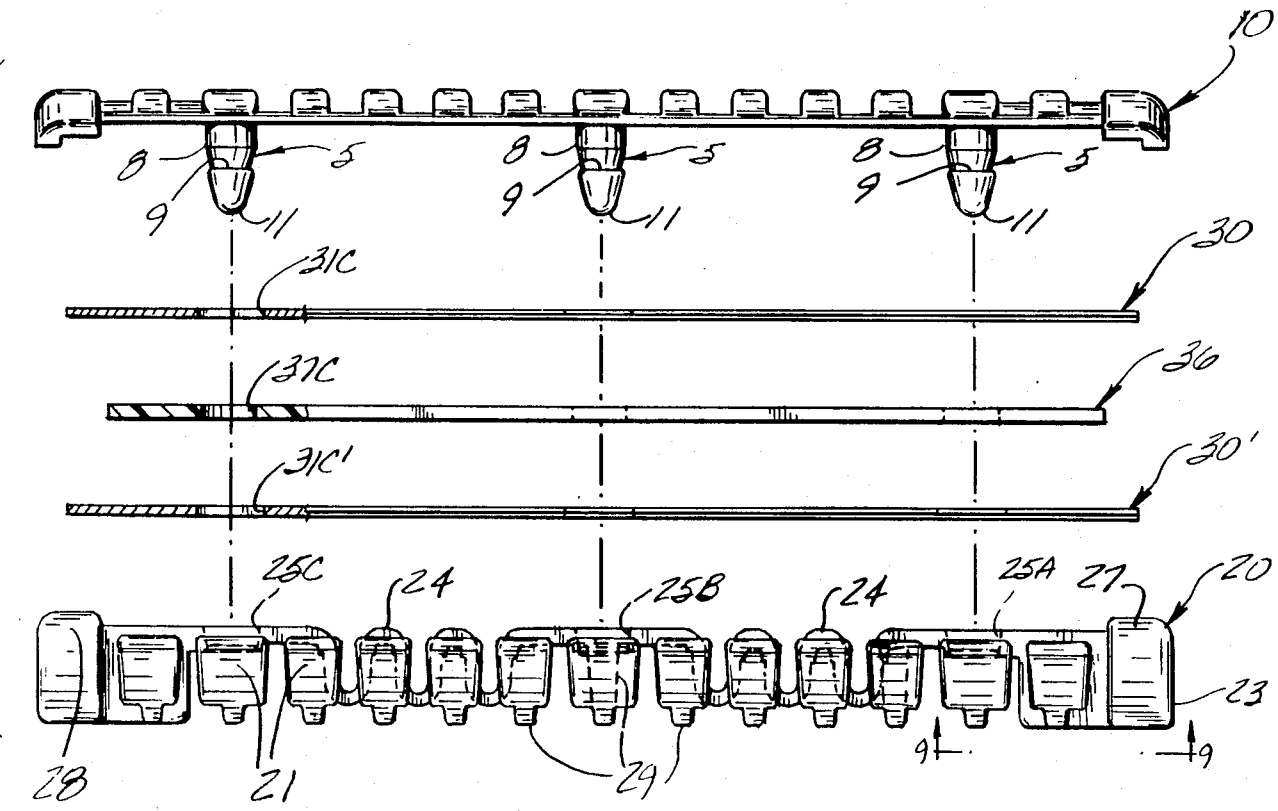
FIG. 4 is an exploded front elevational view shown partially in cross section of the razor head according to this invention.
Figure 5:
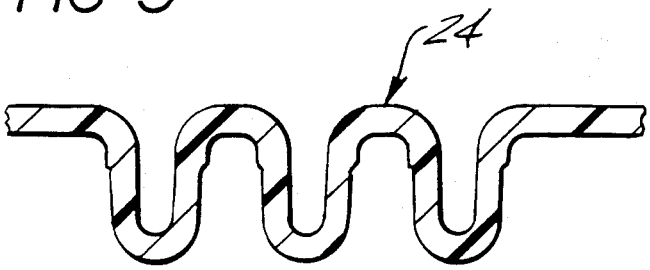
FIG. 5 is a partial rear section taken along lines 5—5 of FIG. 3.

As can be seen by reference particularly to FIGS. 1 3 and 4, the razor heads includes cap 10, seat 20, blades 30 and 30'0 and spacer 36. While the configuration shown at FIG. 3 includes two blades and a spacer, increased flexibility will result if the razor head features only one blade. A certain trade off occurs between the closeness of the shave encountered with two blades and the increased flexibility associated with one blade and, as a result, the choice between these configurations is one based upon economics and design properties.

The cap 10 features raised areas 12 and recessed areas 13. These undercut areas may in fact be open areas such as shown in the Cartwright patent mentioned above. Open areas will decrease strength but will increase flexibility and a balance can be struck in limiting the depth of the open areas or under cutting the thickness in the "open areas." Throughout the specification "open area" is used generically for these variations. Open areas are provided by design in the embodiment depicted at FIG. 3. The cap 10 is provided with raised end areas 14 and end sides 7. The inside surface 6 is designed to mate with raised ends 26 of the blade support portion 20. Upon assembly side 7 of cap 10 and side 23 of blade support 20 form a continuous side surface which acts not only to protect the user from gouging of the blade sides but also forms a barrier to help limit shifting of blades 30 and 30' in a lateral direction. As can best be seen by reference to FIGS. 3 and 4 blades 30 and 30' are identical in configuration although the seat blade is larger in area and feature 3 pin receiving holes 31A', 31B' and 31C' for each blade. Slots 32A' and 32B' are positioned between the pin receiving holes 31A' and 31B' and 31C' respectively.

As shown in FIG. 3, the blade support portion includes flat surface 22 upon which bottom blade 30' rests. Segmented guard bar 28 is attached to flat surface 22 by ribs, and 29 chamfered receiving holes 25A, 25B and 25C are provided for receiving pins 5 having bulbous ends 11, necked in portion 9 and conventional diameter pin portion 8.

Figure 2:
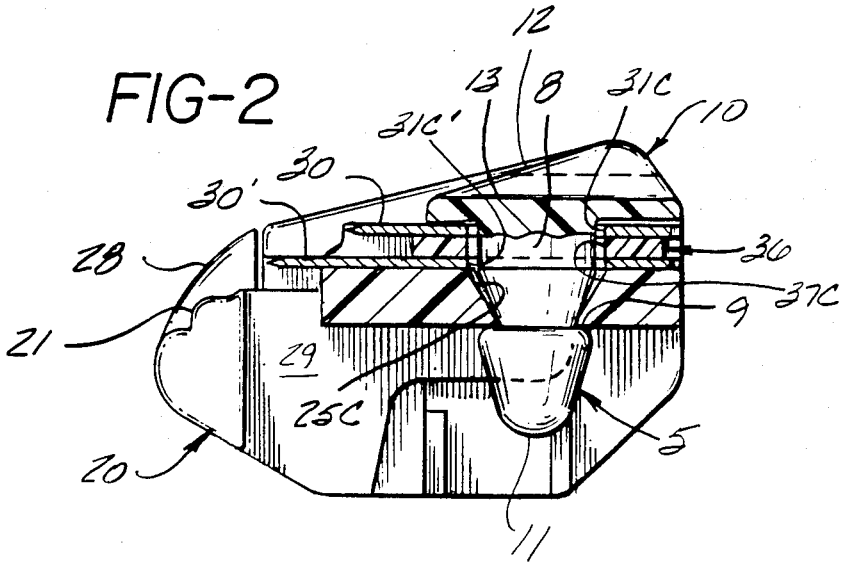
FIGS. 2, 6 and 7 are cross sections taken along the lines 2—2 of FIG. 2.
Figure 6:
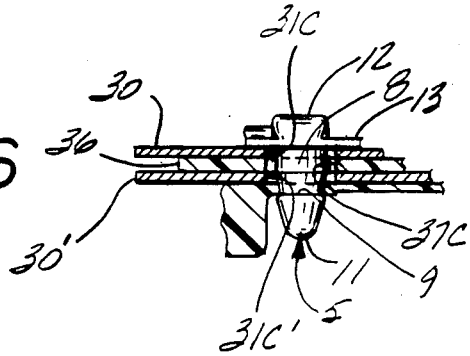
Figure 7:
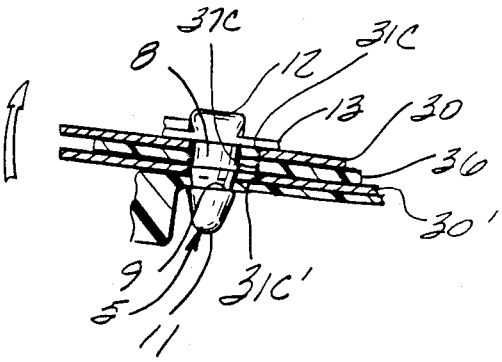

As can best be seen by reference to FIGS. 2, 6 and 7 the pins 5 extend downward through the blades 30 and 30' and spacer 36 (see also FIGS. 3 and 4) while allowing the blades to flex freely up on surface 8 of pin 5.

As shown in FIG. 3, the pins 5 pass through chamfered holes 25 to anchor the cap blades and spacer to the blade support portion. Note that holes 31A, B and C, 31A', 31B' and 31C' are greater in size than the diameter of pin portion 8 and therefore the blades are capable of moving laterally in response to bending forces. The use of a center pin provides the assembly with stability and controlled movement. The slots 32A and 32B in the blades and 38 and 38' in the spacers increase the flexibility of the blades and spacers without structurally weakening either.

The blades have rear end 35 and forward projecting shaving edge 34 parallelly positioned as can best be seen by reference to FIG. 1. As can be seen, the upper or cap blade 30 is positioned with its shaving edge behind the lower or seat blade 30'. This combination is well known in the art.

Figure 8:
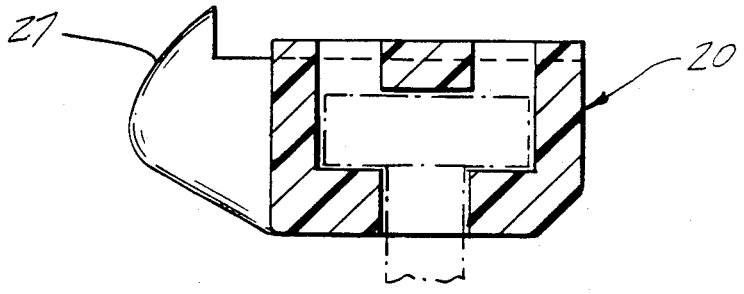
FIG. 8 is a partial cross section of the blade seat taken along lines 8—8 of FIG. 3.
Figure 9:
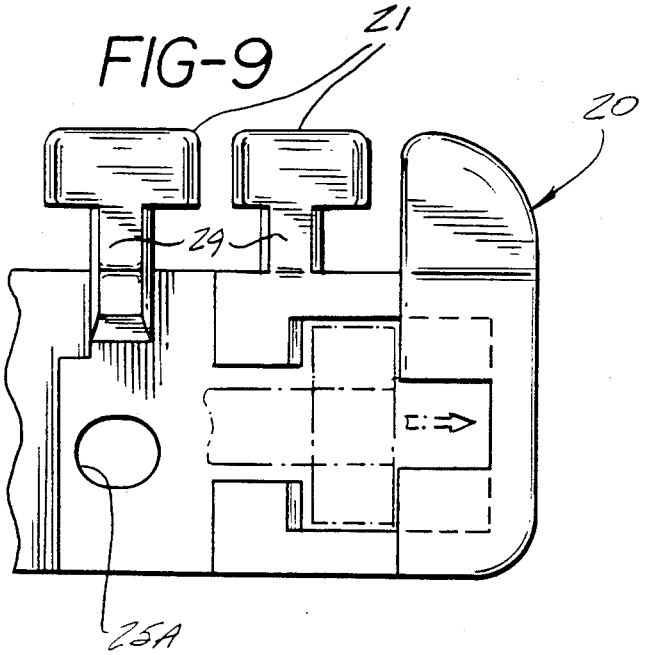
FIG. 9 is a top view of a portion of the seat taken along lines 9—9 of FIG. 4.

Attachment of the razor head is by "inside-out" connection as can best be seen by reference to FIGS. 8 and 9. The handle arms, not shown, are biased to be deflected inward in response to downwardly directing shaving forces. The biased outwardly directed forces maintained the shaving arms in an at rest position. The arms themselves may be resiliently flexible or may be inwardly and/or outwardly biased as desired.

The biasing and/or arm flexing serves to provide a limiting means for downward deflection of the central portion of the head. It is preferred that the maximum amount of downward deflection of the cartridge at its center point be between about 0.090 in. and 0.140 in. and most preferably between about 0.120 and about 0.140 in.

As a measure of total resilience the razor can be described as requiring from 45 to 75 gm of force applied to achieve a deflection of 0.050 in. It is also preferred that the blade package, i.e. the single blade or two blade and spacer combination should contribute from 15 to 30% of the gram force needed to obtain the 0.050 in. value. Preferably the blade package should contribute from 20 to 25% of the 75 to 90 gram force. This is obtained by creating a blade package which flexes in the same locations as the seat and the cap and which has open areas covering between about 15 and about 30% of the surface of the package. As can be seen particularly by reference to FIG. 2 the seat blade is actually larger than the cap blade. It is particularly preferred that the seat blade have an open area of about 25 to about 30%. The cap blade should have about 20 to 25% open area. Deflection values are determined as discussed below.

EXAMPLE 1

The purpose of these tests was to compare the stiffness characteristics of the blade cartridge of this invention and the razor described in Motta, et al and Cartright patents.

Figure 10:
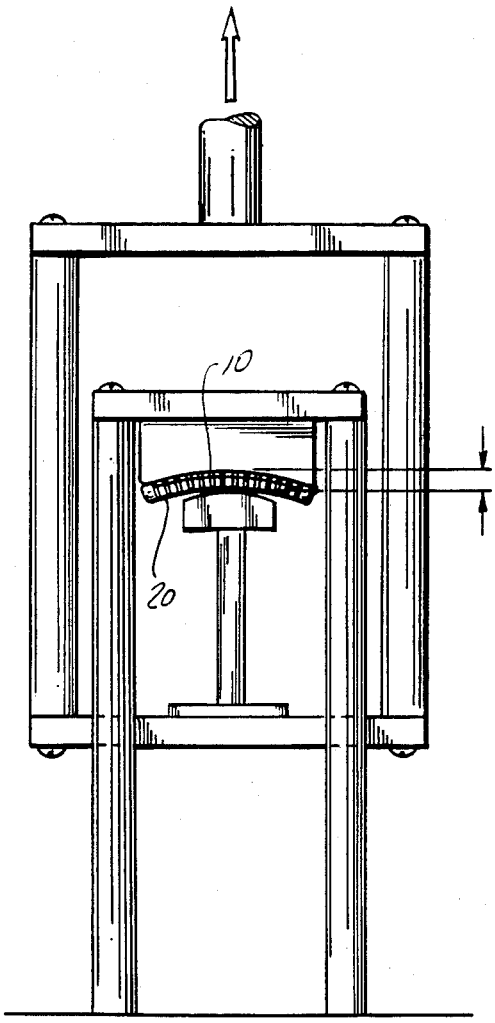
FIG. 10 is a view of the cartridge being tested.

Referring to FIG. 10, the blade cartridge is held in a fixture which is rigidly attached to an "Instron" tensile tester base. A ram fixture, as its name depicts, is kinematically mounted to the movable ram of the Instron and is hung from a calibrated load cell. At the bottom of the ram fixture is a pin which applies a load to the blade cartridge in the cartridge holder as the ram fixture moves upward. The purpose of this system is to apply a known deflection to the blade cartridge and simultaneously measure the force.

Tabulated below are the results of such testing of the blade cartridge as well as a blade pakage made up of two blades and a spacer.

TABLE I

| Blade Cartridge[1] | Load at .050" | Spring Rate (Calculated) |
|---|---|---|
| This invention | 64 grams | 1280 grams/inch |
| Cartright | 39 grams | 760 grams/inch |
| Motta,et al, | 155 grams | 3100 grams/inch |
| **Blade Package** | **Load at .050"** | **Spring Rate (Calculated)** |
| This Invention | 13 grams | 260 grams/inch |
| Cartright | 28 grams | 560 grams/inch |

[1]Blade cartridge consists of blades, spacer, plastic seat, and plastic cap.

The comparative data can be summarized as follows:

1. The proposed design of this invention is 68% more stiff than the Cartright version.

2. The blade assembly stiffness of this is 115% less stiff than the original R and D version.

3. The original Modda, et al model is much more stiff than either the Cartright razor or the version of this invention.

4. The plastic modulus of the plastic used in the Cartright model was less than 5000 psi in order to achieve the desired stiffness characteristics. The proposed design, however, was tested with a modulus of 400,000 psi. There is, therefore, a great deal of room to modify the stiffness by either reducing the elastic modulus, moment of inertia, or a combination of the two.

It is particularly preferred to utilize highly flexible thermoplastic material having high levels of structural integrity. A particularly suitable material is one which is made out of the segmented copolyester elastomer which contains recurring polymeric long chained ester units derived from dicarboxylic acids and long chain diol and short chain ester units derived from dicarboxylic acids and low molecular weight diols. Suitable materials particularly favored for construction of plastic cap and blade support portions are described in U.S. Pat. Nos. 3,766,146 and 3,651,014 by Witsiepe assigned to E. I. du Pont de Nemours and sold under the tradenames Hytrel 5556 and Hytrel 4056 respectively.

It is even possible to make a plastic resilient spacer member out of these particular polymers which will add to the overall resilience of the razor head.

When these compounds are used in part or all of the razor head plastic components the elastic modulus of the head can be minimized and, bearing in mind the resistance programmed from the blade package, a wide range of modulus values can be attained.

I claim:

1. A flexible razor head comprising in combination:

(a) a cap having spaced areas of reduced thickness positioned across its length;

(b) pin means extending downward from a position near each longitudinal underside and center of said cap for assembly of said razor head;

(c) a blade support positioned beneath said cap providing a planar blade support having;

(i) a segmented guard bar extending outwardly therefrom, the spacing between said segments aligned with the areas of reduced thickness of said cap;

(ii) pin receiving means positioned below said pin means; said blade support positions corrugated between said pin receiving means to provide an expanded length when subjected to downward force; and (d) a blade package including at least one blade with pin receiving holes greater in area than the cross-sectional area of said pin means when said head is in its unstressed conditions positioned between said cap and said blade support portion, said blade package having at least 15% to 30% open area.

2. A flexible razor head comprising in combination:

(a) a cap having spaced areas of reduced thickness positioned across its length;

(b) pin means extending downward from a position near each longitudinal underside and center of said cap for assembly of said razor head;

(c) a blade support positioned beneath said cap providing a planar blade support having;

(i) a segmented guard bar extending outwardly therefrom, the spacing between said segments aligned with the areas of reduced thickness of said cap;

(ii) pin receiving means positioned below said pin means; said blade support positions corrugated between said pin receiving means to provide an expanded length when subjected to downward force; and (d) a blade package including at least one blade with pin receiving holes greater in area than the cross-sectional area of said pin means when said head is in its unstressed conditions positioned between said cap and said blade support portion, wherein said flexibility is defined by a force between 45 and 60 gms. to obtain a deflection of 0.50 inches.

3. The razor head of claim 1 wherein the seat blade has an open area of about 25 to about 30%.

4. The flexible razor head of claims 1, 2 or 3 wherein between about 15 and 30% of the gram force needed to define the flexibility is contributed by the blade package.

* * * * *